US010589521B2

(12) United States Patent
Cicili et al.

(10) Patent No.: US 10,589,521 B2
(45) Date of Patent: Mar. 17, 2020

(54) FLUID EJECTION VIA DIFFERENT FIELD-EFFECT TRANSISTORS

(71) Applicant: HEWLETT-PACKARD DEVELOPMENT COMPANY, L.P., Fort Collins, CO (US)

(72) Inventors: Rogelio Cicili, Corvallis, OR (US); Eric Martin, Corvallis, OR (US)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 16/307,072

(22) PCT Filed: Oct. 5, 2016

(86) PCT No.: PCT/US2016/055511

§ 371 (c)(1),
(2) Date: Dec. 4, 2018

(87) PCT Pub. No.: WO2018/067141

PCT Pub. Date: Apr. 12, 2018

(65) Prior Publication Data

US 2019/0217605 A1 Jul. 18, 2019

(51) Int. Cl.
*B41J 2/045* (2006.01)
*B41J 2/14* (2006.01)

(52) U.S. Cl.
CPC ..... *B41J 2/0455* (2013.01); *B41J 2/0458* (2013.01); *B41J 2/04541* (2013.01); *B41J 2/04581* (2013.01); *B41J 2/14088* (2013.01); *B41J 2/14233* (2013.01); *B41J 2002/14467* (2013.01); *B41J 2202/12* (2013.01)

(58) Field of Classification Search
CPC .. B41J 2/0455; B41J 2/04541; B41J 2/14233; B41J 2/04581; B41J 2/14088; B41J 2/0458; B41J 2202/12; B41J 2002/14467
See application file for complete search history.

(56) References Cited

U.S. PATENT DOCUMENTS

| | | | |
|---|---|---|---|
| 6,398,346 B1 | 6/2002 | Anderson et al. | |
| 6,547,353 B2 | 4/2003 | Hopkins | |
| 7,032,986 B2 | 4/2006 | Corrigan | |
| 8,939,531 B2 | 1/2015 | Govyadinov et al. | |
| 2011/0175959 A1* | 7/2011 | Van Brocklin ..... | B41J 2/04541 347/14 |

(Continued)

OTHER PUBLICATIONS

IP.com search (Year: 2019).*

(Continued)

*Primary Examiner* — Lisa Solomon
(74) *Attorney, Agent, or Firm* — HP Inc. Patent Department

(57) ABSTRACT

In one example in accordance with the present disclosure, a fluid ejection device is described. The fluid ejection device includes a number of nozzles to eject an amount of fluid. A first field-effect transistor (FET) activates a first fluidic operation component and a second FET activates a second fluidic operation component. The first FET and the second FET are selected from among a high-side switch FET, a low-side switch FET, and a hybrid FET and the first FET and the second FET are different from one another.

15 Claims, 8 Drawing Sheets

(56) References Cited

U.S. PATENT DOCUMENTS

| | | | |
|---|---|---|---|
| 2013/0057622 | A1 | 3/2013 | Govyadinov et al. |
| 2014/0232791 | A1 | 8/2014 | Gardner et al. |
| 2015/0062222 | A1 | 3/2015 | Ghozeil et al. |
| 2015/0091989 | A1 | 4/2015 | Govyadinov et al. |

OTHER PUBLICATIONS

Aden, J.S. et al., The Third-generation HP Thermal Inkjet Printhead, Feb. 1994, < http://www.hpl.hp.com/hpjournal/94feb/feb94a6.pdf >.

* cited by examiner

FLUID EJECTION VIA DIFFERENT FIELD-EFFECT TRANSISTORS

BACKGROUND

Fluid ejection devices such as inkjet printheads are widely used for precisely, and rapidly, dispensing small quantities of fluid. Such fluid ejection devices come in many forms. For example, fluid ejection devices may dispense fusing agent in an additive manufacturing process or may be used to dispense ink on a print medium such as paper.

BRIEF DESCRIPTION OF THE DRAWINGS

The accompanying drawings illustrate various examples of the principles described herein and are part of the specification. The illustrated examples are given merely for illustration, and do not limit the scope of the claims.

Throughout the drawings, identical reference numbers designate similar, but not necessarily identical, elements.

DETAILED DESCRIPTION

Figure 1:
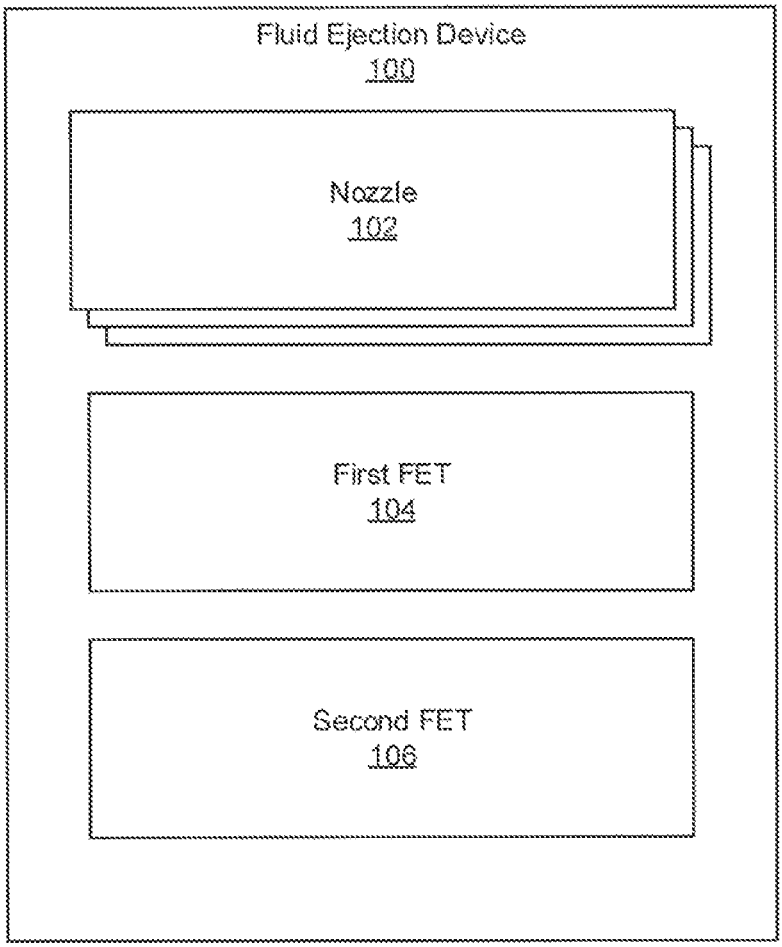
FIG. 1 is a block diagram of a fluid ejection device with field-effect transistors (FETs) having different configurations, according to an example of the principles described herein.

Fluid ejection devices are widely used for precisely, and rapidly, dispensing small quantities of fluid. Such fluid ejection devices come in many forms. For example, fluid ejection devices may dispense fusing agent in an additive manufacturing process or may be used to dispense ink on a print medium such as paper. Droplets of fluid are ejected out of a nozzle orifice by creating a short pulse of high pressure within a firing chamber. An ejector in the firing chamber forces the fluid out the nozzle orifice. Examples of ejectors include thermal ejectors or piezoelectric ejectors. A thermal ejector uses a semiconductor device including a heating element (e.g., resistor) in the firing chamber along with other integrated circuitry. To eject a droplet of fluid, an electrical current is passed through the resistor. As the resistor generates heat, a small portion of the fluid within the firing chamber is vaporized. The vapor rapidly expands, forcing a small droplet out of the firing chamber through the nozzle orifice. The electrical current is then turned off and the resistor cools. The vapor bubble rapidly collapses, drawing more fluid into the firing chamber from a fluid reservoir.

The nozzles may be arranged in columns or arrays such that properly sequenced ejection of fluid from the nozzles causes characters, symbols, and/or other patterns to be formed on the surface; be the surface a layer of build material in an additive manufacturing apparatus or a medium such as paper in an inkjet printer. In operation, fluid flows from a reservoir to the fluid ejection device. In some examples, the fluid ejection device may be broken up into a number of dies with each die having a number of nozzles. To create the characters, symbols, and/or other pattern, a printer, additive manufacturing apparatus, or other component in which the fluid ejection device is installed sends electrical signals to the fluid ejection device via electrical bond pads on the fluid ejection device. The fluid ejection device then ejects a small droplet of fluid from the reservoir onto the surface. These droplets combine to form an image or other pattern on the surface.

The fluid ejection device includes a number of components for depositing a fluid onto a surface. For example, the fluid ejection device includes a number of nozzles. A nozzle includes an ejector, a firing chamber, and a nozzle orifice. The nozzle orifice allows fluid, such as ink or a fusing agent, to be deposited onto a surface, such as powder build material or a print medium. The firing chamber includes a small amount of fluid. The ejector is a mechanism for ejecting fluid through the nozzle orifice from a firing chamber. The ejector may include a firing resistor or other thermal device, a piezoelectric element, or other mechanism for ejecting fluid from the firing chamber.

For example, the ejector may be a firing resistor. The firing resistor heats up in response to an applied voltage. As the firing resistor heats up, a portion of the fluid in the firing chamber vaporizes to form a bubble. This bubble pushes liquid fluid out the nozzle orifice and onto the surface. As the vaporized fluid bubble collapses, pressure within the firing chamber draws fluid into the firing chamber from the fluid supply, and the process repeats.

In another example, the ejector may be a piezoelectric device. As a voltage is applied, the piezoelectric device changes shape which generates a pressure pulse in the firing chamber that pushes a fluid out the nozzle orifice and onto the surface.

Although such fluid ejection devices provide broad functionality at reasonable cost, continued development relies on overcoming various challenges that remain in their development. For example, during fluid deposition, particles that make up the fluid may settle. For example, in ink, colorant particles in the ink can settle out of the solution so that the ink is not properly mixed in the chamber. Also, if the fluid is stationary for too long, it may dry up and crust around the nozzles, which crusting could block fluid flow through the nozzle. Some solutions include servicing the printheads and apparatuses before and after their use. For example, printheads can be capped during non-use to prevent nozzles from clogging with dried ink. Prior to their use, nozzles are also primed by spitting fluid through them. However, there may be an inability to immediately print due to the servicing time, and an increase in the total cost of ownership due to the significant amount of fluid consumed during servicing.

To address this scenario and others, some devices include an auxiliary fluid transport component in a fluid path between a fluid slot and the nozzle. In other words, a fluid ejection device includes a fluid slot, and a nozzle channel coupled to the fluid slot. Disposed in the nozzle channel is a fluid transport component such as a resistor pump, and the nozzle through which the fluid is dispensed. The fluid transport component circulates fluid from the fluid slot, into the nozzle channel and back to the fluid slot past the nozzle where a portion can be ejected through the nozzle orifice. In some examples, the fluid transport component may be other types of fluid actuators, including, for example, piezoelectric-membrane actuators, magnetostrictive drive actuators, electrochemical actuators, or other such microdevices that may cause directional flow of fluid.

In such a fluid ejection device, switching field-effect transistors (FETs) are used to selectively activate the fluid transport component and the nozzles. In a specific example, a FET is used to direct an electrical signal to a pump resistor, which pump resistor moves fluid through the nozzle channel. A firing FET is used to force fluid out of a firing chamber through a nozzle orifice. In this example, the firing FET may be of one configuration that may enhance performance while the fluid transport FET may be of another configuration that preserves space on the fluid ejection device. Specifically, the firing FET may be a high-side switch FET and the fluid transport FET may be a non-high-side switch FET. While specific reference is made to a firing FET and a fluid transport FET, the present specification generally relates to using different configuration of FETS on a single fluidic ejection device to control and activate different fluidic operation components.

Specifically, the present specification describes a fluid ejection device. The fluid ejection device includes a number of nozzles to eject an amount of fluid. The fluid ejection device also includes a first field-effect transistor (FET) to activate a first fluidic operation component and a second FET to activate a second fluidic operation component. The FETs are selected from among a high-side switch (HSS) FET, a low-side switch (LSS) FET, and a hybrid FET and are different from one another.

The present specification also describes a fluid ejection system. The system includes a fluid ejection device that includes a number of nozzles to eject fluid through a number of nozzle orifices and a number of high-side switch firing field-effect transistors (FETs) to select and activate at least one of the number of nozzles. The device also includes a number of non-high-side switch pump FETs to move fluid through the fluid ejection device. The fluid ejection system also includes a controller to 1) eject fluid through the number of nozzle orifices by activating at least one of the number of high-side switch firing FETs; and 2) move fluid through the fluid delivery device by activating at least one of the number of non-high-side switch pump FETs.

The present specification also describes a fluid ejection device that includes a fluid slot to transport fluid between a fluid reservoir and nozzles that eject the fluid. On the device are a number of fluid ejection cells fluidly connected to the fluid slot. Each fluid ejection cell includes a nozzle to eject an amount of fluid through a nozzle orifice, a firing field-effect transistor (FET) to select and activate an ejector of the nozzle, and a fluid transport FET to selectively move fluid between the fluid slot and the fluid ejection cell. The firing FET and the fluid transport FET are selected from a high-side switch FET, a low-side switch FET, and a hybrid FET and are different from one another.

In one example, using such a fluid ejection device 1) provides for enhanced performance where desired, i.e., for use in activating a fluid ejector; 2) saves cost and space by using a lower-cost FET to activate other components; 3) provides increased flexibility in device design by implementing different configurations of FETS to activate different fluid operation components; and 4) provides increased performance via fluid re-circulation. However, it is contemplated that the devices disclosed herein may address other matters and deficiencies in a number of technical areas.

As used in the present specification and in the appended claims, the term "nozzle" refers to an individual component of a fluid ejection device that dispenses fluid onto a surface. The nozzle includes at least a firing chamber, an ejector, and a nozzle orifice.

Further as used in the present specification and in the appended claims, the term "fluidic operation component" refers to a component of the fluid ejection device that operates on the fluid. Examples, of such fluidic operation components include a fluid ejection component, a fluid transport component, a fluid level sensing component, a fluid property sensing component, a fluid diagnostic component, a cell counting component, a fluid heating component and a fluid agitation component. However, other examples of such fluidic operation components may be implemented in accordance with the principles described herein.

As used in the present specification and in the appended claims, the term "a number of" or similar language is meant to be understood broadly as any positive number including 1 to infinity.

FIG. 1 is a block diagram of a fluid ejection device (100) with field-effect transistors (FETs) (104, 106) having different configurations, according to an example of the principles described herein. The fluid ejection device (100) may be implemented in various systems. For example, some fluid ejection devices (100) may dispense fusing agent in an additive manufacturing process or may be used to dispense ink on a print medium such as paper.

The fluid ejection device (100) includes a number of nozzles (102) to eject an amount of fluid. Each nozzle includes a firing chamber to bold the amount of fluid. Fluid may pass into the firing chamber via a fluid slot that is fluidically connected to a fluid supply such as an ink reservoir or a fluid agent reservoir. An ejector that is disposed within the firing chamber works to eject the amount of fluid through a nozzle orifice.

The ejector may be of varying types. For example, the ejector may be a firing resistor. The firing resistor heats up in response to an applied voltage. As the firing resistor heats up, a portion of the fluid in the firing chamber vaporizes to form a bubble. This bubble pushes liquid fluid out the nozzle orifice and onto the surface. As the vaporized fluid bubble collapses, pressure within the firing chamber draws fluid into the firing chamber from the fluid supply, and the process repeats.

In another example, the ejector may be a piezoelectric device. As a voltage is applied, the piezoelectric device changes shape which generates a pressure pulse in the firing chamber that pushes a fluid out the nozzle orifice and onto the surface.

The fluid ejection device (100) also includes a first field-effect transistor (FET) (104) to activate a first fluidic operation component. For example, the first fluidic operation component may be a fluid ejection component such as the ejector. The fluid ejection device (100) also includes other fluid operation components that are activated by a FET. Accordingly, the fluid ejection device (100) includes a second FET (106) to activate a second fluidic operation component. The FETs (104, 106) operate to selectively pass an electrical signal to a corresponding fluidic operation component. Specifically, as voltage is passed to a gate of the FET, the FET is activated, thus allowing current to pass through to a connected fluidic operation component. An ejector is one example of a fluidic operation component. Other examples include a fluid transport component, a fluid level sensing component, a fluid property-sensing component, a fluid diagnostic component, a fluid cell-counting component, a fluid heating component, and a fluid agitation component. While specific examples are provided of various fluidic operation components, other such components may be implemented in accordance with the principles described herein.

Different configuration of FETs (104, 106) have different characteristics. For example, as will be described below in connection with FIGS. 5A-5D, a high-side switch FET is upstream of the fluidic operation component and includes a level shifter coupled to the gate of the FET, a drain voltage coupled to the drain of the FET, and the fluidic operation component coupled to a source of the FET. By comparison, a low-side switch FET is downstream of the fluidic operation component and does not include such a level shifter. In a low-side switch FET, the drain of the FET is coupled to the fluidic operation component, the source is coupled to ground, and the gate is coupled to a control voltage. In yet another example, a hybrid FET combines aspects of both a low-side switch FET and a high-side switch FET. In this example, one FET is upstream of various fluidic operation components that are parallel to one another, and each individual fluidic operation component is coupled to a downstream FET. As will be described below, each of the different kinds of FETs has different operations. In the present fluid ejection device (100), different configurations of the FETs (104, 106) may be used in a single fluid ejection device (100). For example, the fluid ejection device (100) may include the first FET (104) which is configured as a high-side switch FET, a low-side switch FET, or a hybrid FET. The second FET (106) is also configured as a high-side switch FET, a low-side switch FET, or a hybrid FET, but is different from the first FET (104) such that multiple configurations of FETs are used on a single fluid ejection device (100). Doing so allows FETs to be selected based on their characteristics to enhance overall performance of the fluid ejection device (100). In other words, a fluid ejection device (100) can be tailored to different configurations. For example, a high-side switch FET may be used to activate an ejector where enhanced performance is desired and a low-side switch FET may be used to activate a fluid transport component where reduced size and cost is desired.

Figure 2:
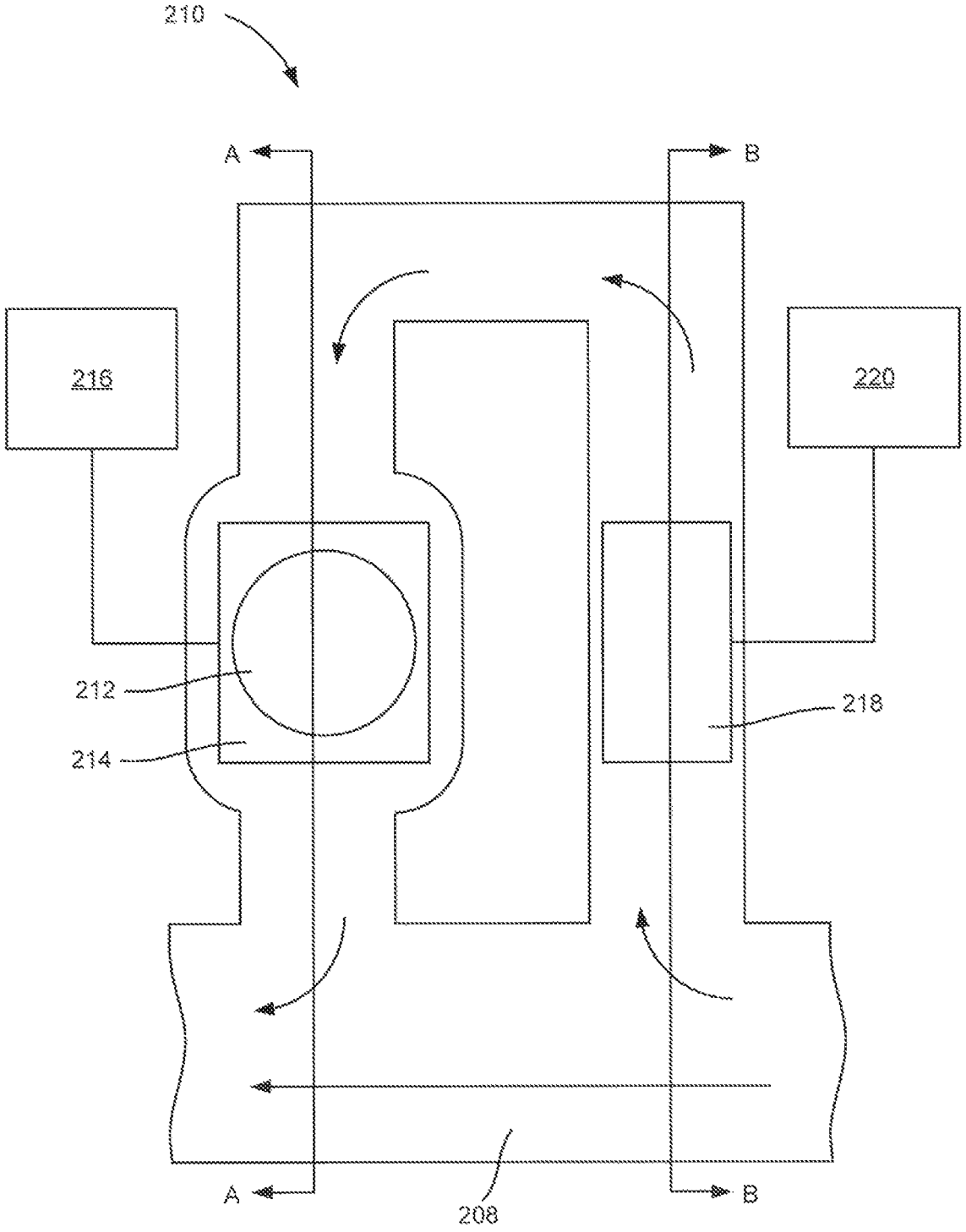
FIG. 2 is a diagram of a fluid ejection device with FETs having different configurations, according to an example of the principles described herein.

FIG. 2 is a diagram of a portion of a fluid ejection device (FIG. 1, 100) with FETs (216, 220) having different configurations, according to an example of the principles described herein. In one example, the fluid ejection device (FIG. 1, 100) includes a fluid slot (208) that is in fluid communication with a fluid reservoir and transports fluid between the fluid reservoir and the nozzles (FIG. 1, 102) that eject the fluid. That is, the fluid slot (208) brings fluid from the fluid reservoir to the nozzle (FIG. 1, 102) to be ejected, and returns fluid unused by the nozzle (FIG. 1, 102) to the fluid reservoir to be recycled and reused.

The fluid ejection device (FIG. 1, 100) includes a number of fluid ejection cells (210) that are fluidly connected to the fluid slot (208). For simplicity. FIG. 2 depicts a single fluid ejection cell (210). However, any number of fluid ejection cells (210) may be disposed along the fluid slot (208). A group of multiple fluid ejection cells (210) can be referred to as a primitive where each primitive includes a group of adjacent fluid ejection cells (210). A primitive can include any number of fluid ejection cells (210), such as six, eight, ten, fourteen, sixteen, and so on.

Figure 3:
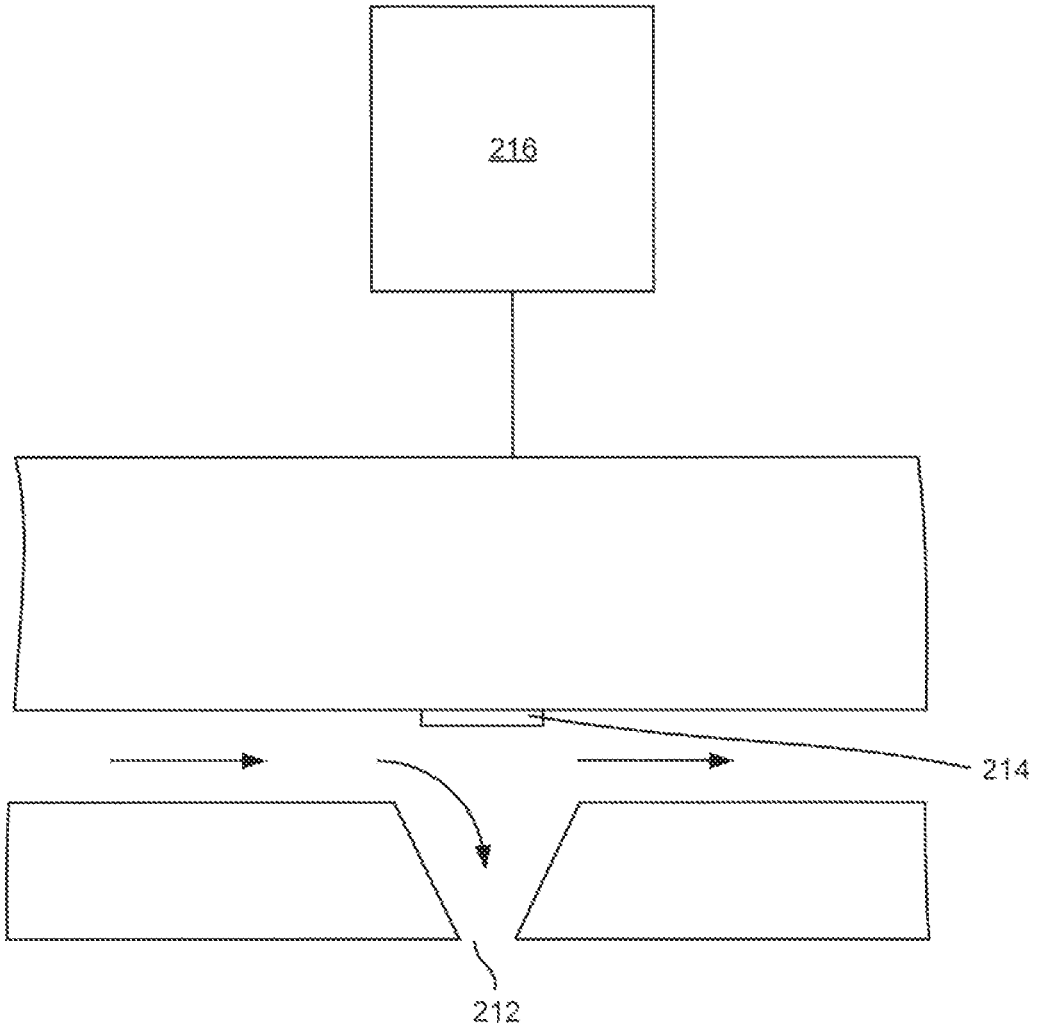
FIG. 3 is a cross-sectional view of a nozzle of a fluid ejection device with FETs having different configurations, according to an example of the principles described herein.

Each fluid ejection cell (210) includes a number of components to assist in the ejection of fluid from the nozzle (FIG. 1, 102) and transportation of the fluid throughout the fluid ejection device (FIG. 1, 100). Specifically, the fluid ejection cell (210) includes a nozzle (FIG. 1, 102) to eject an amount of fluid. Each nozzle (FIG. 1, 102) includes a firing chamber, a nozzle orifice (212), and an ejector (214). FIG. 3 depicts a cross-sectional diagram of a portion of the fluid ejection device (FIG. 1, 100) that includes the nozzle (FIG. 1, 102) and the associated nozzle orifice (212) and ejector (214). Specifically, FIG. 3 is a portion of the cross-section referenced by the line A-A in FIG. 2.

As depicted in FIG. 3, in some examples the ejector (214) is a resistor that heats up in response to applied electrical energy. As the resistor heats up, it creates a vapor bubble that forces fluid out the nozzle orifice (212) as indicated by the arrows in FIG. 3. A firing field-effect transistor (216), which may be an example of the first FET (FIG. 1, 104) is electrically coupled to the ejector (214) of the nozzle to select and activate the ejector (214). That is the firing FET (216) allows current to pass through to the resistor and heating it up to ultimately eject fluid through the nozzle orifice (212). A portion of the fluid that is not ejected through the nozzle orifice (212) is passed back to the fluid slot (208) via the operation of the fluid transport component (218).

In other examples, the ejector (214) may be a piezoelectric membrane-based fluid actuator in which the piezoelectric membrane thereof may deform in response to applied electrical energy. When the membrane deforms, fluid proximate the membrane may be displaced such that the fluid flows out through the nozzle orifice (212) as indicated by the arrows in FIG. 3.

Figure 4:
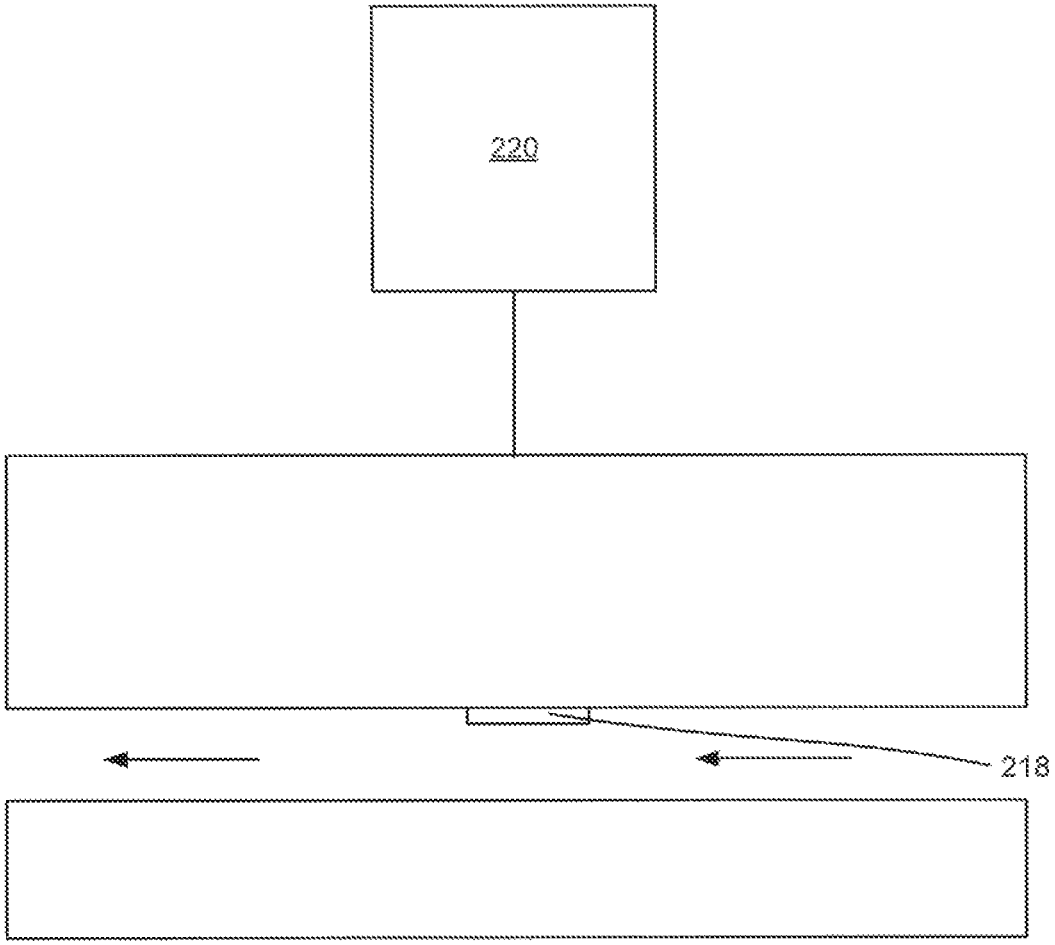
FIG. 4 is a cross-sectional view of a fluid transport component of a fluid ejection device with FETs having different configurations, according to an example of the principles described herein.

The fluid ejection cell (210) also includes a fluid transport component (218) to move fluid through the fluid ejection cell (210). FIG. 4 depicts a cross-sectional diagram of a portion of the fluid ejection device (FIG. 1, 100) that includes the fluid transport component (218). Specifically, FIG. 4 is a portion of the cross-section referenced by the line B-B in FIG. 2.

As depicted in FIG. 4, the fluid transport component (218) efficiently moves fluid through the fluid ejection cell (210) to be ejected and facilitates recirculation of unused fluid. Specifically, as described above, settling of the fluid and allowing the fluid to remain station for too long a time period can impact performance. Including such a fluid transport component (218) aids in the reduction of these performance-impacting scenarios and also ensures quick and efficient flow of fluid through the entire fluid ejection device (FIG. 1, 100).

In some examples, the fluid transport component (218) is a resistor that heats up in response to applied electrical energy. As the resistor heats up, it creates a vapor bubble that forces fluid through the channel of the fluid ejection cell (210) as indicated by the arrows in FIG. 4. A fluid transport FET (220), which may be an example of the second FET (FIG. 1, 106) is electrically coupled to the fluid transport component (218) to activate the fluid transport component (218), i.e., heat up the resistor, to move fluid through the channel of the fluid ejection cell (210). That is, the fluid transport FET (220) allows current to pass through to the resistor, heating it up to move fluid through the channel. In other examples, the fluid transport component (218) may be a piezoelectric membrane-based fluid actuator in which the piezoelectric membrane thereof may deform in response to applied electrical energy. When the membrane deforms, fluid proximate the membrane may be displaced such that the fluid flows through the channel of the fluid ejection cell (210) as indicated by the arrows in FIG. 4. In some examples, the ejector (214) and fluid transport component (218) are different from one another. For example, the ejector (214) may be a thermal resistor and the fluid transport component (218) may be a piezoelectric membrane-based fluid actuator. In another example, the ejector (214) is a piezoelectric membrane-based fluid actuator, and the fluid transport component (218) is a thermal resistor.

Returning to FIG. 2 the different FETS (216, 220) may be selected from the group of a high-side switch (HSS) FET a low-side switch (LSS) FET, and a hybrid FET. For example, the firing FET (216) may be an HSS FET and the fluid transport FET (220) may be an LSS FET or a hybrid FET. In another example, the firing FET (216) may be a hybrid FET, and the fluid transport FET (220) may be an HSS FET or an LSS FET. Accordingly, different FET configurations may be implemented on a fluid ejection device (FIG. 1, 100) to carry out different functions.

Different configurations of FETs have different characteristics. Specifically, an HSS FET may provide more consistent energy regulation while an LSS FET may provide greater cost savings and take up less space in the fluid ejection device (FIG. 1, 100). In one example the firing FET (216) may be an HSS FET as it provides a more consistent flow of energy to the ejector (214). In other words, if the flow of current to an ejector (214) resistor varies to a large degree, it may affect printing. For example, if voltage at the ejector (214) droops, there may be less power to dispense fluid resulting in different qualities of fluid drops being ejected. Accordingly, an HSS FET, which ensures greater uniformity of energy pulse to the ejector (214), would result in more uniform fluid droplets, thereby increasing the quality of ejection.

By comparison, the fluid transport FET (220) may be a non-high-side switch FET as other FETS may be more cost effective and smaller, thus reducing their footprint on the fluid ejection device (FIG. 1, 100). For example, the fluid transport FET (220) may be an LSS FET or a hybrid FET which may not have the same voltage regulation capabilities as an HSS FET, but that are smaller. In a pumping operation, uniform current may not be as relevant, so a FET that offers reduced silicon space and reduced cost may be more efficiently used as a fluid transport FET (220).

As depicted in FIG. 2, the number of firing FETs (216) and the number of fluid transport FETs (220) may be organized in a pair-wise fashion. However, in some examples, the number of firing FETs (216) in a fluid ejection device (FIG. 1, 100) may be greater than the number of fluid transport FETs (220). This is because a single nozzle (FIG. 1, 102) may implement an individual firing FET (216), but a single fluid transport FET (220) may be coupled to multiple nozzles (FIG. 1, 102).

Figure 5A:
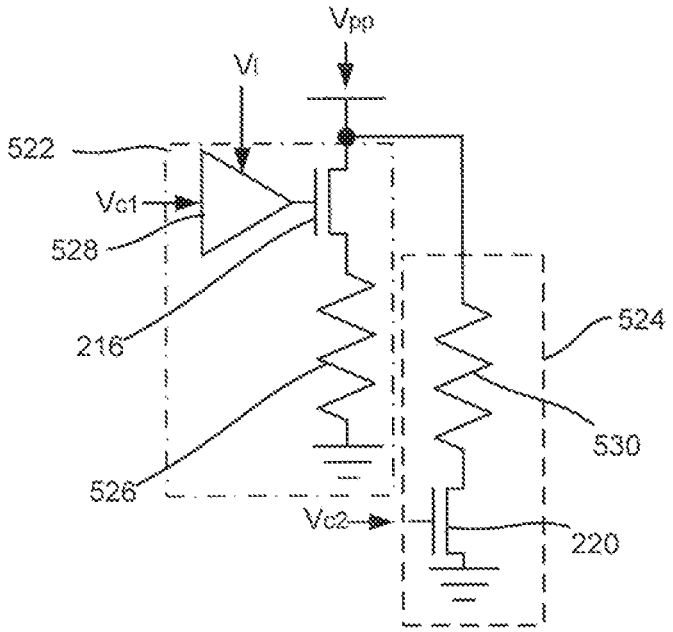
FIGS. 5A-5D are circuit diagrams of the fluid ejection device with FETs having different configurations, according to examples of the principles described herein.

FIGS. 5A-5D are circuit diagrams of the fluid ejection device (FIG. 1, 100) with FETs (216, 220) having different configurations, according to examples of the principles described herein. Specifically, FIG. 5A depicts a circuit depiction of a firing zone (522) and a circuit depiction of a fluid transport zone (524). In FIGS. 5A-5D the firing zone (522) is depicted with a dashed-dot line and the fluid transport zone (524) is depicted with a dashed line. A firing zone (522) may be defined as that portion of a fluid ejection cell (FIG. 2, 210) that includes the nozzle (FIG. 1, 102) and corresponding components to dispense fluid from the nozzle (FIG. 1, 102). The fluid transport zone (524) may be defined as that portion of a fluid ejection cell (FIG. 2, 210) that includes a fluid transport component (FIG. 2, 218) and corresponding components to move fluid throughout the fluid ejection cell (FIG. 2, 210).

Specifically, FIG. 5A depicts a circuit where a first FET (FIG. 1, 104), for example a firing FET (216) is an HSS FET and a second FET (FIG. 1, 106) such as a fluid transport FET (220) is an LSS FET. An HSS FET is a FET that is upstream of the firing resistor (526). In the firing zone (522) in this example, each resistor (526) is connected to ground on one end and are coupled to a supply voltage, $V_{pp}$, when the corresponding firing FET (216) is activated. In this regard, a HSS FET provides increased reliability as there is isolation between adjacent resistors (526).

Moreover, the HSS FET offers increased voltage regulation. For example, under heavy deposition loads the supply voltage, $V_{pp}$, may drop. A drop in $V_{pp}$ may result in a lower current through the firing resistor (526). The lower current through the firing resistor (526) introduces variation to fluid drop mechanics. In fluid deposition, consistent drop mechanics are desired to improve deposition quality. Accordingly, the HSS firing FET gate is coupled to a level shifter (528) that 1) activates the firing FET (216) to select a corresponding firing resistor (526) and 2) provides a gate voltage that regulates current flow through the firing resistor (526).

Specifically, the level shifter (528) receives as input a low voltage control signal, $V_c$, and a logic voltage, $V_l$. The control signal $V_c$, selects the particular firing resistor (526) for activation and the logic voltage, $V_l$, regulates the gate voltage on the firing FET (216). In FIG. 5A, the designations $V_{c1}$ and $V_{c2}$ indicate different instances of a control signal. In this circuit, the voltage seen at the top of the firing resistor (526) is a function of the gate voltage, so even if $V_{pp}$ were to vary as described above, the voltage across the firing resistor (526) would stay constant as long as $V_l$ stays constant. In other words, the level shifter (528) provides consistent current through the firing resistor (526) which improves print quality. The HSS FET (216) isolates the firing resistor (526) from other resistors such that a failure of one resistor does not propagate to others in the primitive. That is, failure of one firing resistor (526) would be contained to that single resistor (526) and not propagated to other resistors.

In the example depicted in FIG. 5A, the fluid transport FET (220) is an LSS FET, meaning that the fluid transport FET (220) is downstream of a fluid transport resistor (530). In this example, the top node of the fluid transport resistor (530) is directly coupled to the supply voltage, $V_{pp}$, and the transport resistor (530) is selected and activated by a control signal, $V_c$, on the fluid transport FET (220) which activates the gate to complete the circuit in the fluid transport zone (524).

As the LSS fluid transport FET (220) does not include a level shifter (528), it is cheaper to manufacture and takes up less space on the fluid ejection device (FIG. 1, 100). While the LSS FET may not offer the same voltage regulation control as the HSS FET, such control may not be relevant on the fluid transport zone (524) where uniform energy pulses are less relevant. In other words, using a LSS FET as the fluid transport FET (220) reduces the footprint of the FET on the fluid ejection device (FIG. 1, 100) at the expense of voltage regulation, where strict voltage regulation is not as relevant.

Figure 5B:
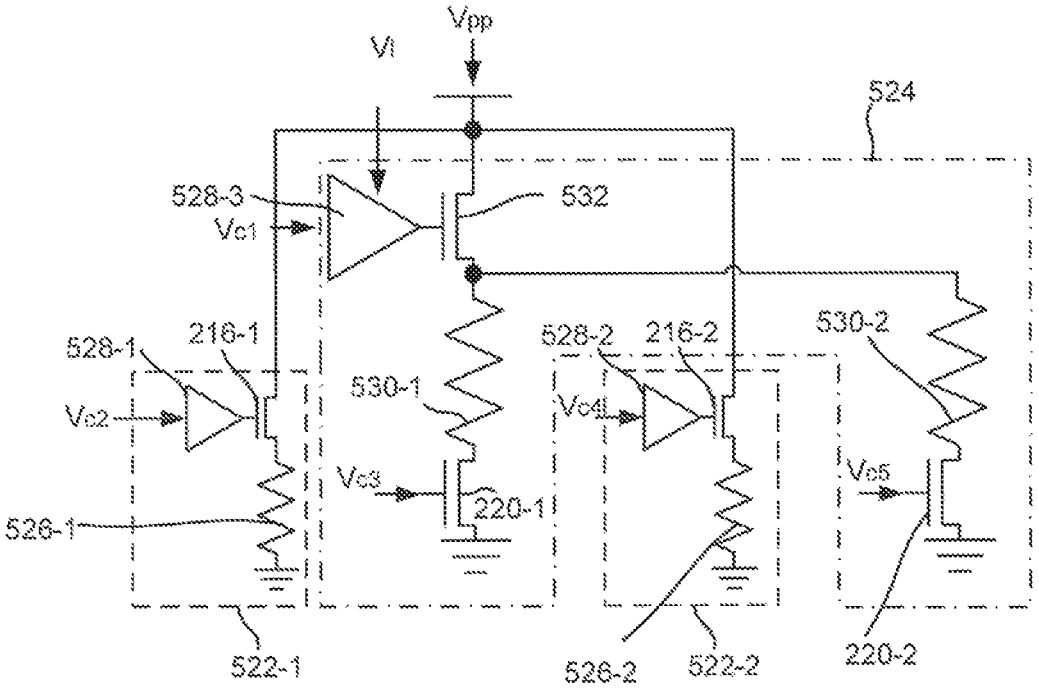

FIG. 5B depicts a circuit where a first FET (FIG. 1, 104), for example a firing FET (216) is a high-side switch FET and a second FET (FIG. 1, 106) such as a fluid transport FET (220) is a hybrid switch FET. For ease of illustration multiple firing zones (522-1, 522-2) each having an HSS firing FET (216-1, 216-2), level shifters (528-1, 528-2) and firing resistors (526-1, 526-2) are depicted.

Returning to the hybrid FET, a hybrid FET combines features of an HSS FET and an LSS FET. Specifically, in the fluid transport zone (524), there is one level shifter (528-3)

per primitive, the level shifter (528-3) being similar to the level shifters described in previous figures. The presence of a level shifter (528-3) and an upstream FET (532) upstream of the primitive is consistent with an HSS FET. Furthermore in the hybrid fluid transport zone (524), each fluid transport resistor (530-1, 530-2) includes an LSS fluid transport FET (220-1, 220-2) where each individual fluid transport resistor (530) is selected via a control signal, $V_c$, at the gate of the LSS FET. In FIG. 5B, the designations $V_{c1}$, $V_{c2}$, $V_{c3}$, $V_{c4}$, and $V_{c5}$ indicate different instances of a control signal. Implementing a hybrid FET in the fluid transport zone (524) increases reliability of the operation of the fluid transport FETS by isolating the FETS from the supply voltage.

Figure 5C:
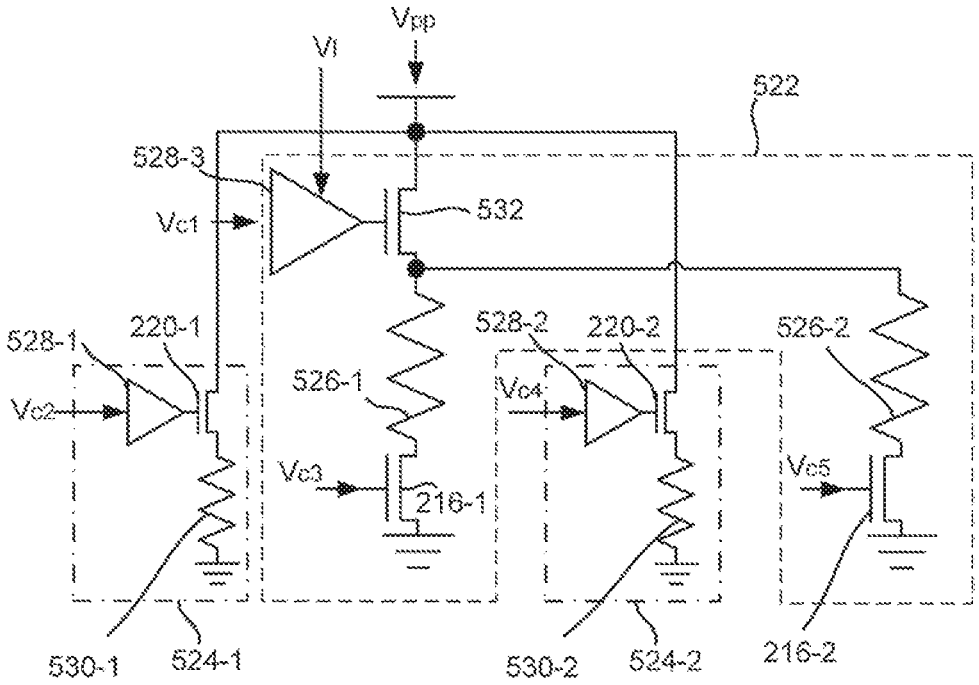

FIG. 5C depicts a circuit where a first FET (FIG. 1, 104), for example a firing FET (216-1, 216-2) is a hybrid switch FET and a second FET (FIG. 1, 106) such as a fluid transport FET (220-1, 220-2) is an HSS FET. For ease of illustration, multiple fluid transport zones (524-1, 524-2) each having an HSS firing FET (220-1, 220-2), level shifters (528-1, 528-2) and firing resistors (530-1, 530-2) is depicted. In FIG. 5C, the designations $V_{c1}$, $V_{c2}$, $V_{c3}$, $V_{c4}$, and $V_{c5}$ indicate different instances of a control signal.

As described above, in this example, the firing zone (522) may include a hybrid switch FET meaning, one level shifter (528-3) per primitive of firing cells, an upstream FET (532), and each firing resistor (526-1, 526-2) being coupled on the downstream side to a firing FET (216-1, 216-2).

Figure 5D:
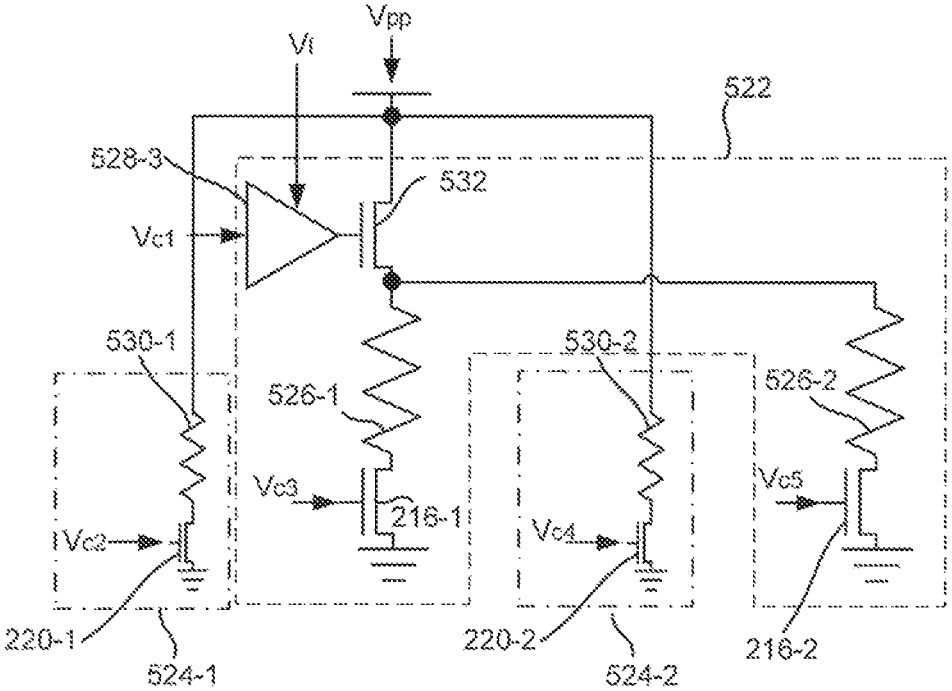

FIG. 5D depicts a circuit where first FETs (FIG. 1, 104), for example firing FETs (216-1, 216-2) are hybrid switch FETs and second FETs (FIG. 1, 106) such as a fluid transport FETs (220-1, 220-2) are LSS FETs. For ease of illustration, multiple fluid transport zones (524-1, 524-2) each having a low-side switch firing FET (220-1, 220-2), and firing resistors (530-1, 530-2).

As described above, in this example, the firing zone (522) may include a hybrid switch FET meaning, one level shifter (528-3) per primitive of firing cells, an upstream FET (532), and each firing resistor (526-1, 526-2) being coupled on the downstream side to another FET (216-1, 216-2). In FIG. 5D, the designations $V_{c1}$, $V_{c2}$, $V_{c3}$, $V_{c4}$, and $V_{c5}$ indicate different instances of a control signal.

Figure 6:
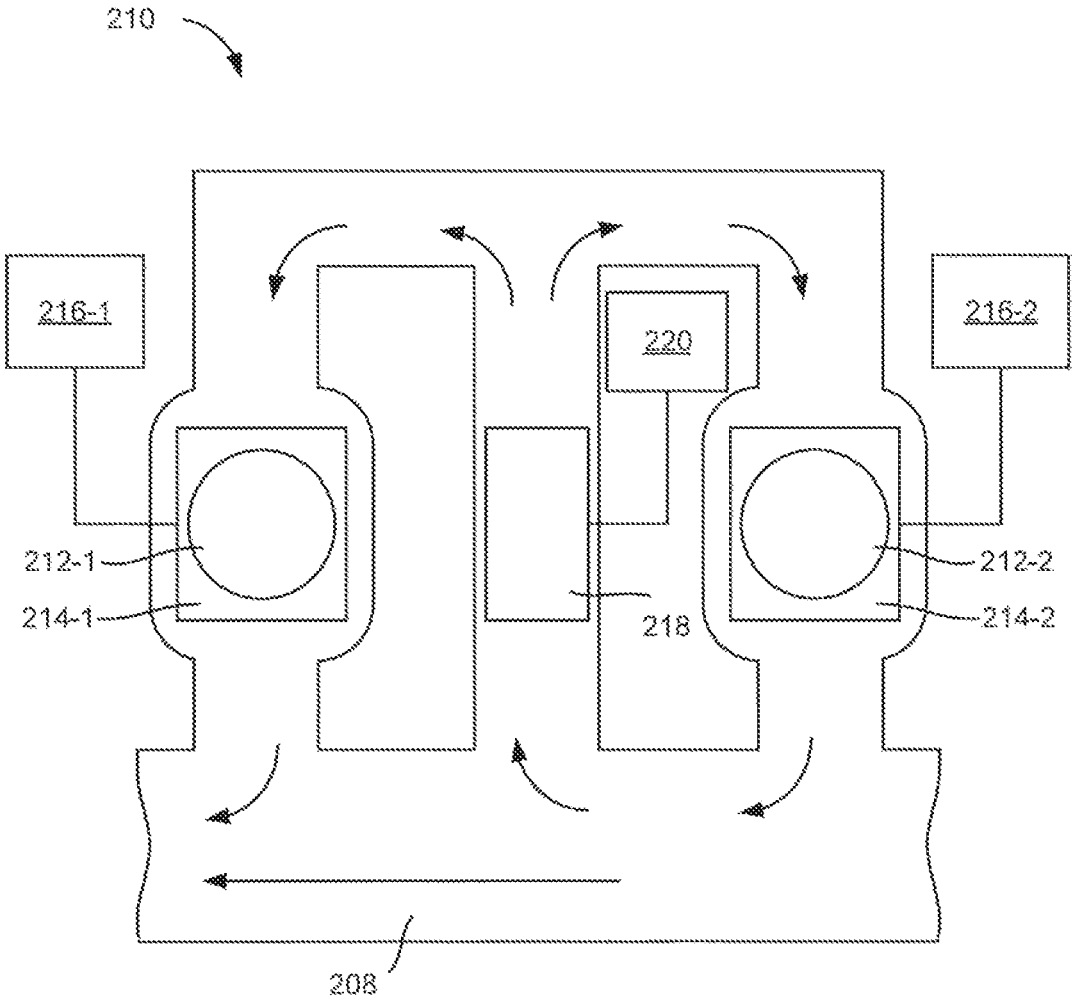
FIG. 6 is a diagram of a fluid ejection device with FETs having different configurations, according to another example of the principles described herein.

FIG. 6 is a diagram of a fluid ejection device (FIG. 1, 100) with FETs (216, 220) having different configurations, according to another example of the principles described herein. As described above in FIG. 2, the fluid ejection device (FIG. 1, 100) includes a fluid slot (208) that is in fluid communication with a fluid reservoir and transports fluid between the fluid reservoir and the nozzles (FIG. 1, 102) that eject the fluid. That is the fluid slot (208) brings fluid from the fluid reservoir to the nozzle (FIG. 1, 102) to be ejected, and returns fluid unused by the nozzle (FIG. 1, 102) to the fluid reservoir to be recycled and reused in subsequent operations.

As described above, the fluid ejection cell (210) includes a fluid transport component (218) to move fluid through the fluid ejection cell (210). While FIG. 2 depicted the number of firing FETs (216) and fluid transport FETs (220) in a pair-wise configuration, in some examples, the number of firing FETs (216) in a fluid ejection device may be greater than the number of fluid transport FETs (220). That is one fluid transport component (218) can be used to increase fluid flow to multiple nozzles (FIG. 1, 102), i.e., by multiple ejectors (214) and multiple nozzle orifices (212). Put another way, multiple firing FETs (216-1, 216-2) may be grouped with an individual fluid transport FET (220).

Figure 7:
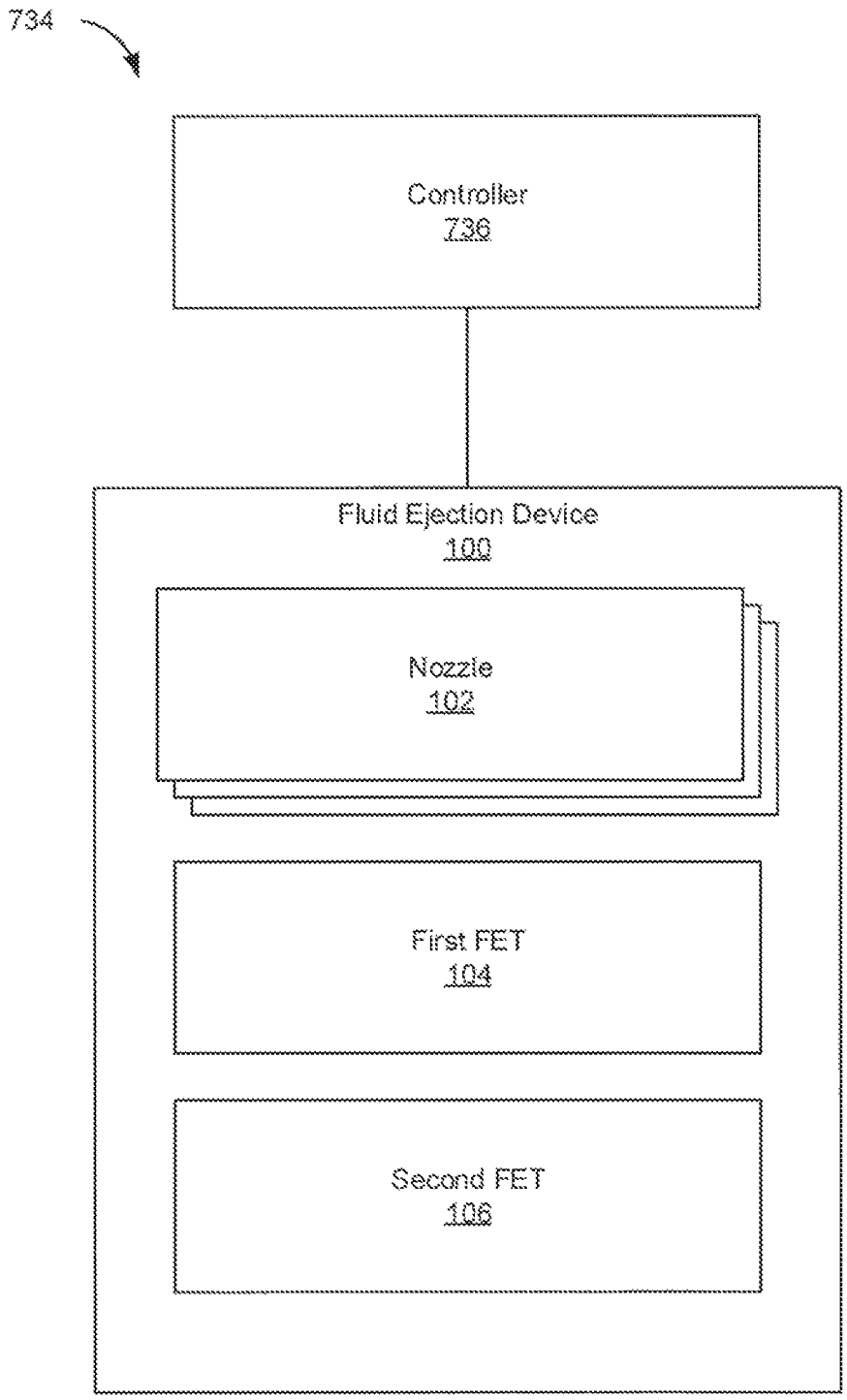
FIG. 7 is a diagram of a system for ejecting fluid, according to an example of the principles described herein.

FIG. 7 is a diagram of a system (734) for ejecting fluid, according to an example of the principles described herein. The system (734) includes a fluid ejection device (100) which includes the number of nozzles (102), the number of first FETS (104) which may be HSS firing FETs, and the number of second FETs (108), which may be non-high-side switch fluid transport FETs. The system (734) also includes a controller (736) to eject fluid through the number of nozzle orifices (FIG. 2, 212) by activating at least one of the number of first FETs (104). The controller (736) also moves fluid though the fluid ejection device (100) by activating at least one of the number of non-high-side second FETs (106).

The controller may include a processor and other components including volatile and non-volatile memory components, and other electronics for communicating with and controlling the fluid ejection device (100). The controller (736) receives data from a host system, such as a computer, and temporarily stores data in a memory. Data represents, for example, a document and/or file to be printed. As such, data forms a job for printing or additive manufacturing and includes job commands and/or command parameters.

The controller (736) controls the fluid ejection device (100) for ejection of fluid drops from nozzles (102). The controller (736) defines a pattern of ejected fluid drops that form characters, symbols, and/or other graphics or images on a surface. The pattern of ejected drops is determined by the job commands and/or command parameters.

In one example, using such a fluid ejection device 1) provides for enhanced performance where desired, i.e., for use in activating a fluid ejector; 2) saves cost and space by using a lower-cost FET to activate other components; 3) provides increased flexibility in device design by implementing different configurations of FETS to activate different fluid operation components; and 4) provides increased performance via fluid re-circulation. However, it is contemplated that the devices disclosed herein may address other matters and deficiencies in a number of technical areas.

The preceding description has been presented to illustrate and describe examples of the principles described. This description is not intended to be exhaustive or to limit these principles to any precise form disclosed. Many modifications and variations are possible in light of the above teaching.

What is claimed is:

1. A fluid ejection device comprising:

a number of nozzles to eject an amount of fluid;

a first field-effect transistor (FET) to activate a first fluidic operation component; and a second FET to activate a second fluidic operation component;

wherein:

the FETs are selected from the group consisting of a high-side switch FET, a low-side switch FET, and a hybrid FET; and the second FET is different from the first FET.

2. The device of claim 1, wherein:

the first fluidic operation component is an ejector; and the second fluidic operation component is a fluid transport component.

3. The device of claim 1, wherein the first FET is a high-side switch FET and the second FET is a low-side switch FET.

4. The device of claim 1, wherein the first FET is a high-side switch FET and the second FET is a hybrid switch FET.

5. The device of claim 1, wherein the first FET is a hybrid switch FET and the second FET is a low-side switch FET.

6. The device of claim 1, wherein the first FET is a hybrid switch FET and the second FET is a high-side switch FET.

7. The device of claim 1, wherein the fluidic operation components are selected from the group consisting of a fluid level sensing component, a fluid property sensing component, a fluid diagnostic component, a fluid heating component, a fluid agitation component, and a cell counting component.

8. A fluid ejection system comprising:

a fluid ejection device comprising:

a number of nozzles to eject fluid through a number of nozzle orifices;

a number of high-side switch firing field-effect transistors (FETs) to select and activate at least one of the number of nozzles; and a number of non-high-side switch fluid transport FETs to move fluid through the fluid ejection device; and a controller to:

eject fluid through the number of nozzle orifices by activating at least one of the number of high-side switch firing FETs; and move fluid through the fluid delivery device by activating at least one of the number of non-high-side switch fluid transport FETs.

9. The system of claim 8, wherein the number of high-side switch firing FETs are organized in a pair-wise fashion with the number of non-high-side switch fluid transport FETs.

10. The system of claim 8, wherein the number of high-side switch firing FETs is greater than the number of non-high-side switch fluid transport FETs.

11. The system of claim 9, wherein multiple high-side switch firing FETs is grouped with an individual low-side switch pump FET.

12. A fluid ejection device comprising:

a fluid slot to transport fluid between a fluid reservoir and nozzles that eject the fluid;

a number of fluid ejection cells fluidly connected to the fluid slot, each fluid ejection cell comprising:

a nozzle to eject an amount of fluid through a nozzle orifice;

a firing field-effect transistor (FET) to select and activate an ejector of the nozzle; and a fluid transport FET to selectively move fluid between the fluid slot and the fluid ejection cell;

wherein the firing FET and the fluid transport FET are:

selected from the group consisting of a high-side switch FET, a low-side switch FET, and a hybrid FET; and different from one another.

13. The device of claim 12, wherein:

the ejector and a fluid transport component are selected from the group consisting of a thermal resistor and a piezoelectric membrane-based fluid actuator; and the fluid transport component is different than the ejector.

14. The device of claim 12, wherein the firing FET is a high-side switch FET.

15. The device of claim 12, wherein:

a high-side switch FET comprises:

a level shifter coupled to a gate of the high-side switch FET;

a drain voltage coupled to a drain of the high-side switch FET; and a fluid operation component coupled to a source of the high-side switch FET;

a low-side switch FET comprises:

a fluidic operation component coupled to a drain of the low-side switch FET; and a source of the low-side switch FET coupled to ground; and a hybrid FET comprises:

a first FET coupled to various fluidic operation components that are parallel to one another; and a second FET that is coupled to each individual fluidic operation component.

* * * * *